US012201872B2

(12) United States Patent
Horn et al.

(10) Patent No.: US 12,201,872 B2
(45) Date of Patent: Jan. 21, 2025

(54) FITNESS DEVICE

(71) Applicant: Advanced Kinetix LLC, Royse City, TX (US)

(72) Inventors: Kelli Jean Horn, Royse City, TX (US); Craig Dean Horn, Royse City, TX (US)

(73) Assignee: ADVANCED KINETIX LLC, Royse City, TX (US)

( * ) Notice: Subject to any disclaimer, the term of this patent is extended or adjusted under 35 U.S.C. 154(b) by 108 days.

(21) Appl. No.: 17/849,361

(22) Filed: Jun. 24, 2022

(65) Prior Publication Data

US 2023/0024013 A1 Jan. 26, 2023

Related U.S. Application Data

(60) Provisional application No. 63/215,284, filed on Jun. 25, 2021.

(51) Int. Cl.
*A63B 21/00* (2006.01)
*A63B 21/015* (2006.01)

(52) U.S. Cl.
CPC ..... *A63B 21/4033* (2015.10); *A63B 21/0004* (2013.01); *A63B 21/015* (2013.01)

(58) Field of Classification Search
CPC ..... A63B 21/4033; A63B 21/0004; A63B 21/015; A63B 21/0557; A63B 2023/006; A63B 2210/50; A63B 2225/09; A63B 21/4035
See application file for complete search history.

(56) References Cited

U.S. PATENT DOCUMENTS 1,714,391 A * 5/1929 McWhirter ..... A63B 21/015 482/148
3,942,790 A * 3/1976 Rice ..... A63B 21/012 482/131
4,203,591 A * 5/1980 Gibson ..... A63B 23/14 482/46
4,274,430 A * 6/1981 Schaaf ..... A61H 3/00 135/65
4,395,039 A * 7/1983 Kaiser ..... A63B 23/12 482/131
4,770,414 A * 9/1988 Fredrickson ..... A63B 23/0227 482/148

(Continued)

FOREIGN PATENT DOCUMENTS

CA 1239158 A 7/1988
DE 10 2009 039 742 A1 1/1900

*Primary Examiner* — Andrew S Lo
(74) *Attorney, Agent, or Firm* — Foley & Lardner LLP

(57) ABSTRACT

A fitness tool for a user to use in performing stretching or other fitness activities may include a first member including (i) a first elongated shaft, the first elongated shaft including a first interface feature on a first end of the first elongated shaft, and (ii) a handle disposed at the second end. A second member may include a second elongated shaft, where the second elongated shaft may include a second interface feature at a first end of the second elongated shaft. The first and second interface features, when longitudinally engaged with one another, may enable the first and second shafts to rotate relative to one another. The second elongated shaft may include a hand or foot engagement mechanism.

22 Claims, 7 Drawing Sheets

(56) References Cited

U.S. PATENT DOCUMENTS 5,167,596 A * 12/1992 Ferber ..... A63B 21/00069 482/45
5,776,083 A * 7/1998 Jacob ..... A63B 23/00 482/131
6,027,434 A * 2/2000 Gibbons ..... A61H 1/0237 482/131
6,330,888 B1 * 12/2001 Aravantinos ..... A61H 3/061 135/84
6,773,378 B2 * 8/2004 Bastyr ..... A63B 21/0004 482/114
7,090,626 B1 * 8/2006 Miller ..... A63B 21/4035 482/44
7,674,185 B2 * 3/2010 Omidi ..... A63B 69/3632 473/223
8,047,974 B1 * 11/2011 Kanelos ..... A63B 21/08 482/106
8,852,063 B2 * 10/2014 Bua ..... A61H 1/0281 482/907
9,675,837 B2 * 6/2017 Smith ..... A63B 21/02
9,750,970 B2 * 9/2017 Kennedy ..... A63B 21/4035
10,022,578 B2 7/2018 Kelly
10,398,921 B1 * 9/2019 Walsh ..... A63B 59/70
10,413,776 B2 9/2019 Lewis
2002/0082102 A1 6/2002 Reilly
2004/0185990 A1 * 9/2004 Orescan ..... A63B 69/36 482/121
2008/0081747 A1 * 4/2008 Mok ..... A63B 21/0552 482/121
2009/0264267 A1 * 10/2009 Ballif ..... A63B 21/0004 482/139
2010/0323858 A1 * 12/2010 Yang ..... A63B 21/4035 482/121
2013/0331234 A1 * 12/2013 Niederman ..... A63B 21/4035 482/46
2015/0335934 A1 11/2015 Flynn
2016/0354630 A1 * 12/2016 Kennedy ..... A63B 21/0004
2017/0120100 A1 * 5/2017 Smith ..... A63B 21/02
2020/0030656 A1 * 1/2020 Hurlbut ..... A63B 23/03508
2021/0060381 A1 * 3/2021 Lalaoua ..... A63B 21/4035
2022/0265010 A1 * 8/2022 Campbell ..... A63B 23/16

* cited by examiner

FITNESS DEVICE

RELATED APPLICATIONS

This application claims priority to U.S. Provisional Application having Ser. No. 63/215,284 filed on Jun. 25, 2021, the contents of which are hereby incorporated by reference in their entirety.

BACKGROUND OF THE INVENTION

Fitness devices can be used as wellness tools or rehabilitation tools for mobility, stretching, and/or strength training. The elderly, who often have balancing challenges and who often have difficulty moving or properly moving their lower extremities in certain orientations, such as onto different surface heights, also benefit from performing fitness exercises using fitness devices. Fitness devices may be used by individuals to stretch arms, legs, chests, shoulders, torsos, backs, etc., and may come in a wide variety of shapes and sized. While many devices are beneficial, many have restrictions due to weight and physical constraints that limit certain motions. For example, some devices are embodied as machines, while others are individual devices. For the individual fitness devices, it has been found that certain limitations of the devices exist that make it challenging for the user to receive maximum stretch and flexibility as a result of the devices not providing proper gripping capabilities, being too short, being too flexible along certain planes, or otherwise. In some cases, the fitness devices are intentionally limited to being used for stretching or exercising a single anatomical region (e.g., arms, legs, chest, shoulders, etc.), which then requires a user to purchase other fitness device(s) to stretch or exercise other anatomical regions. As such, there is a need for a fitness device that enables users of all ages, sizes, and stretching and/or fitness capabilities to use for stretching or exercising various anatomical regions in an easy manner.

SUMMARY OF THE INVENTION

To provide for a fitness tool that overcomes the shortcomings of conventional fitness tools, a fitness tool for a user to use in performing stretching or other fitness activities may provide for a shaft with a handle or other interface feature (e.g., grip, strap, etc.) at each end along with a rotational connecting feature that allows for the handles to independently rotate relative to one another. Length of the shaft may be adjustable, thereby providing for different sized users to use the device and perform different modalities that demand different lengths of the tool to be performed by a user.

A fitness tool may include a first member including (i) a first elongated shaft, the first elongated shaft including a first interface feature on a first end of the first elongated shaft, and (ii) a handle disposed at the second end. A second member may include a second elongated shaft, where the second elongated shaft may include a second interface feature at a first end of the second elongated shaft. The first and second interface features, when longitudinally engaged with one another, may enable the first and second shafts to rotate relative to one another. The second elongated shaft may include a hand or foot engagement mechanism such that when the user holds the handle with one hand and the hand or foot engagement mechanism with the other hand or foot is able to cause the first and second members to rotate about the longitudinal axis relative to one another.

The first and second elongated shafts may be tubular and engage with one another using a quick connect (or quick release) fitting that allows for the first and second elongated shafts to rotate relative to one another such that the first and second interface features that are mounted to the respective first and second elongated shafts may rotate relative to one another. By enabling the first and second interface features to rotate relative to one another while being maintained a fixed distance from one another, a user may be provided with the ability to perform stretching and conditioning exercises that are not possible with other fitness tools. In an embodiment, a stretchable component, such as a band, may be disposed within and connect the first and second elongated shafts, thereby allowing a user to perform resistance exercises with the first and second elongated shafts being separated from one another using a single exercise tool that also enables the first and second interface features to be maintained at a fixed distance from one another.

BRIEF DESCRIPTION OF THE DRAWINGS

Illustrative embodiments of the present invention are described in detail below with reference to the attached drawing figures, which are incorporated by reference herein and wherein.

DETAILED DESCRIPTION OF THE INVENTION

Figure 1:
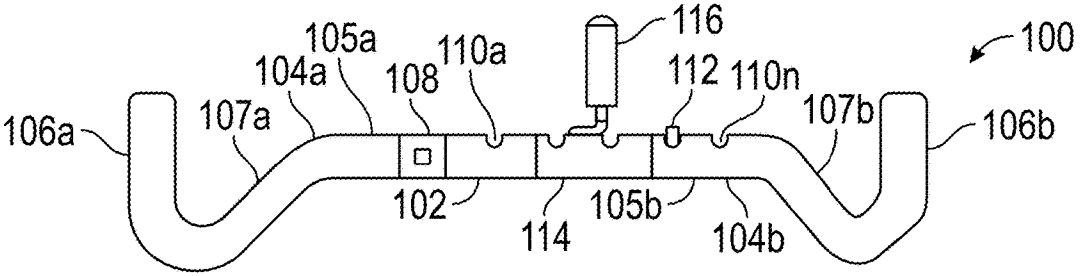
FIGS. 1-5 are illustrations of an illustrative fitness device or tool that may be used by a user to stretch, strengthen, and/or activate anatomical regions.
Figure 2:
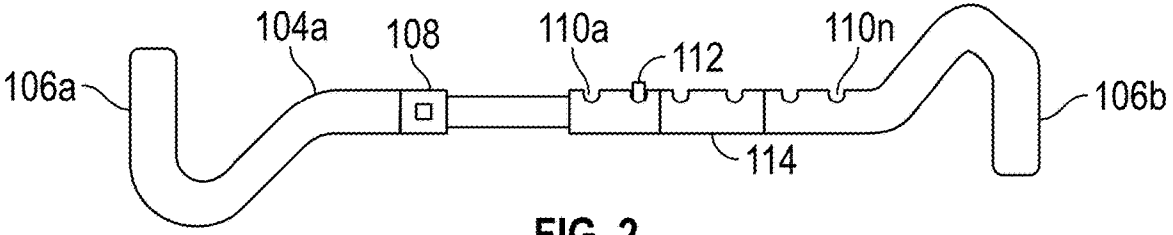

With regard to FIGS. 1-5, illustrations of an illustrative fitness device or tool 100 that may be used by a user to stretch, strengthen, and/or activate anatomical regions him or herself are shown. The fitness device 100 may be used by medical professionals, individuals including children, who are very active in any or all sports/activities, fitness enthusiasts, a traveling or office/business person, a stay-at-home mom/dad, etc. The fitness device 100 may be used to improve a user's overall flexibility and strengthening needs to improve posture, physical performance, such as regaining or increasing range of motion (ROM) for everyday use following a non-surgical and/or surgical injuries. In using the fitness device, multi-plane movements may be performed while using active range of motion (AROM), active assisted range of motion (AAROM), and/or passive range of motion (PROM) techniques when moving lower extremities (LEs) and upper extremities (UEs) into positions that could not be obtained actively due to joint or connective tissue restrictions and/or increased pain.

The user may initiate self-traction techniques within the joints to reduce joint compression, prevent impingement, and be able to target more of the muscles and connective tissue, such as fascia, which may limit motion superficially or at a much deeper level within the body. The fitness device may enable users to have full control of the amount of traction being applied during each movement depending on his or her own personal needs and precautions, which could be increased or decreased depending on needs and tolerance at the time of use of the user. Following mobility training, the user may then utilize resistance band(s) in a shaft portion of an embodiment of the fitness device 100 for neuromuscular re-education for proper muscle activation to allow for stabilization and strengthening within the newly restored ROM with isometric or isotonic contractions to maximize results and prevent injury.

As shown, one embodiment of the fitness device 100 may include three main portions, which may be easily disassembled and reassembled in a matter of seconds, thereby making the fitness device 100 with a configuration the same or analogous to the one(s) shown in FIGS. 1-5 portable, light weight, compact, and easy to use. The fitness device 100 may include a shaft 102 and end members 104*a* and 104*b* (collectively 104). The shaft 102 and end members 104*a* and 104*b* may be linearly interconnected or releasably engaged with one another. The end members 104*a* and 104*b* may include user interface features 106*a* and 106*b* (collectively 106) that a user may grip or press his or her foot against while doing an exercise with the tool 100. The end members 104*a* and 104*b* may have respective elongated portions 105*a* and 105*b* that are linear and configured to be aligned with the shaft 102. In an embodiment, one of the portions 105*b* may extend over and surround a portion of the shaft 102, while the other portion 105*a* may have a common diameter with the shaft 102. In another embodiment, one of the portions 105*a* or 105*b* may be configured to extend through the shaft 102 or connect to an inner shaft component (see FIGS. 10A and 10B) or outer shaft that includes interconnect features on both ends thereof so that one of the end components can connect to one end of the inner (or outer shaft) and the other end can connect to the shaft. In an embodiment, the inner or outer shaft component may include spring pins, as further described herein, to interconnect with an opening defined by the shaft 102. It should be understood that a variety of configurations (e.g., different diameters, same diameters, etc.) that enable the shaft 102 and end members 104 to be interconnected with one another such that the diameters of the different portions of the shaft 102 and end members 104 may be configured to support the different configurations.

End members 104 are shown to have the user interface features 106 being at 90 degree angles with respect to a central axis of the shaft 102. To enable the user to more easily grip or place his or her foot against the interface features 106, curved regions 107*a* and 107*b* (collectively 107) of the end members 104 may allow the user to grasp the user interface features 106 in alignment with the central axis of the shaft 102 so that motions are more comfortable and controllable. The curved regions 107 may have a concave shape, linear portion, linear and curved portion(s), etc., and have any profile and angle (e.g., 30 degrees to 60 degrees) that allows sufficient space for a hand or foot to grip or press against the user interface features 106. In an embodiment, the curved regions 107 are identical to one another. In another embodiment, the curved regions 107 have different shapes or profiles. It should be understood that the device 100 may have different user interface features 106 such that curved regions 107 may have different shapes when different user interface features 106 are releasably connected to the shaft 102. Although the user interface features 106 are shown to be at 90 degree angles relative to the central axis of the shaft 102, it should be understood that the user interface features 106 may be at different angles or at adjustable angles relative to the central axis of the shaft 102 to enable a user to perform different exercises.

In an embodiment, a quick connect QC (or quick release QR) component 108 of FIG. 1 with male and female features (see also FIGS. 9A and 9B) may allow for unrestricted and unlimited rotation (i.e., 360 degree rotation) for the user interface features 106 (e.g., handle(s) or strap(s)) with the capabilities of being quickly and easily exchanged between different exercises with minimal disruption for a user during a workout/mobility routine. The male and female features of the quick release component 108 may be fixedly attached to the shaft 102 and end member 104*a*. Although a single quick release component 108 is shown, it should be understood that one or more additional quick release components may be utilized (e.g., a second quick release component connecting the shaft 102 and end member 104*b*.

The shaft may define multiple openings 110*a*-110*n* (collectively 110), optionally linearly aligned along a plane, such that a spring pin 112 (FIGS. 1 and 2) supported by end member 104*b* may provide for easy length adjustment between the shaft and end member 104*b* to accommodate for people of different heights and for different body positioning and movements when using the tool 100. The shaft 102 and end members 104 may be stiff in that it may be made of a material that resists bending. For example, the shaft 102 and end members 104 may be formed of metal (e.g., aluminum, aluminum alloy, steel, etc.) or plastic (e.g., PVC, acrylic, etc.) that is sufficiently strong and stiff that the user may use the device 100 without causing the shaft 102 and/or end members 104 to become permanently deformed. Other materials may be utilized. Using the spring pin 112, the shaft 102 and end member 104*b* may be releasably connected to one another and the user interface 106*b* may remain at a fixed distance from the user interface 106*a* when the fitness device 100 is assembled.

In the middle of the shaft 102, a hand grip 114, which may be formed of a soft foam or rubber, may allow for additional hand placement for certain exercises using the device 100. The hand grip 114 may be formed of any other material. In an embodiment, a handle 116 that may be locked into place at one or more locations along the shaft 102 to help stabilize the fitness device 100 for further comfort, accommodate for any motion restrictions that the individual may have, and prevent UE positions that cause increased strain or joint impingement during different movements, especially when performing LE exercises.

The handle 116 may be rotatable by inclusion of a hinge mechanism (e.g., pin on one side of a handle support) to allow for the handle 116 to extend perpendicular from the shaft 102 or extend in parallel with the shaft 102. In an alternative embodiment, the handle 116 may be configured to be releasably attached in multiple orientations, such as 0 degrees, 45 degrees, and 90 degrees relative to the shaft 102. A T-pipe connector (not shown), pipe clamp, or any other attachment mechanism may be used to secure the handle 116 in one or more locations along the shaft 102. The attachment mechanism may be removably attached or fixedly attached to the shaft 102. If fixedly attached, multiple attachment mechanisms may be attached to the shaft 102 and the handle may be repositioned to connect to each one, as desired. In an embodiment, a spring pin, clamp, or other attachment mechanism that may engage the shaft 102 may be used to alter position of the handle 116 along the shaft 102.

By including the quick connect 108 that reduces friction when the user is engaged with the interface features 106 (e.g., handles/strap) and rotates the interface features 106 relative to one another, a smooth motion between multi-plane movements is possible, thereby creating fluid motions for the UEs and LEs when transitioning in and out of open-packed versus close-packed positions for different areas of strengthening and to obtain further motion in a more comfortable position so as to minimize or prevent joint irritation. As shown in FIG. 1, the interface features 106*a* and 106*b* are facing the same direction, but in FIG. 2, the interface features 106*a* and 106*b* are facing in opposite directions, where relative rotation occurs at the quick connect 108. It should be understood that the interface features 106 may be angled between 0 degrees and 359 degrees relative to one another while in use, and rotate in either direction as a result of using the quick connect 108.

Although the fitness device 100 shown may include three portions (e.g., shaft 102 and two end members 104), it should be understood that two or more than three portions may be utilized and be releasably interconnected with one another when used by a user. If formed with two portions, one of the end members 104 may be fixedly engaged with or formed with the shaft 102 and the other one of the end members 104 may be connected to the shaft 102. In such an embodiment, length may not be adjustable. By using three or more portions, the device 100 may be taken apart and fit into a shorter carrying case or bag as the portions may be shorter, thereby being more convenient for transport. Embodiments of the fitness device 100 may additionally include those shown in co-pending U.S. Design patent application having Ser. No. 29/836,387 filed on Apr. 26, 2022; the contents of which are hereby incorporated by reference in their entirety.

Figure 3:
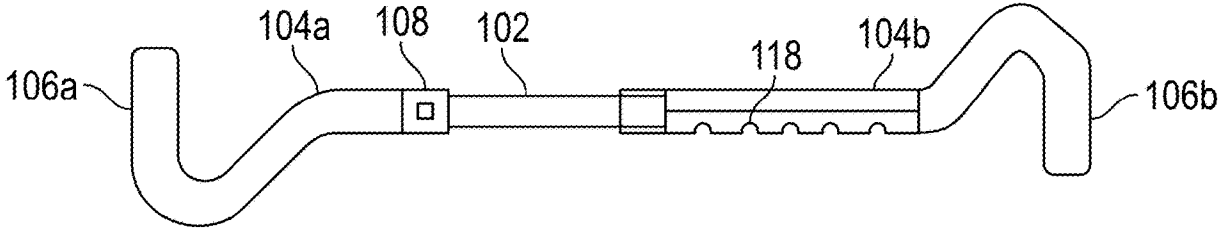

As shown in FIG. 3, within the shaft 102, a resistance band may be positioned and secured to both end members 104, where the end members 104 include shaft portions that are coaxial with one another and may separate from one another to allow a the resistance band to provide for resistance exercises (e.g., stability/strength exercises). Resistance levels may be adjustable as a function of the resistance band for the exercise and tolerance for both eccentric and concentric muscle contractions. In an embodiment, a locking component (not shown) may be located on the shaft 102 (or either or both of the end members 104) for easy access to lock or unlock the shaft by a user when changing from mobility training to stabilization/strength training. The locking component may include a pin that extends through openings defined by the end members 104 and/or middle shaft 102, if a middle shaft is included in the embodiment. Alternative locking component(s), such as a clasp or other moveable and/or stationary locking mechanism to prevent relative rotation between then interface features 106 (e.g., handles (see FIG. 1) or handle and strap (see FIG. 5)).

As further shown in FIG. 3, the shaft 102 may be connected to the end members 104*a* via the quick connect 108 and have one end of the resistance band 118 attached to the shaft 102 and the other end of the resistance band 118 may attached to the end member 104*b*. In an embodiment, the end member 104*b* may be sized to slide allow for sliding along the shaft 102, but not separate or extend past the distal end from the end member 104*a*, thereby maintaining the shaft and end member 104*b* in physical contact with one another and limiting the device 102 with linear motion when using the resistance band 118. A physical stop (not shown) may prevent separation between the shaft 102 and end member 104*b*. Alternatively, the shaft 102 and end member 104*b* may be allowed to separate from one other, thereby allowing for free motion exercises by the user when using the resistance band 118.

Figure 4:
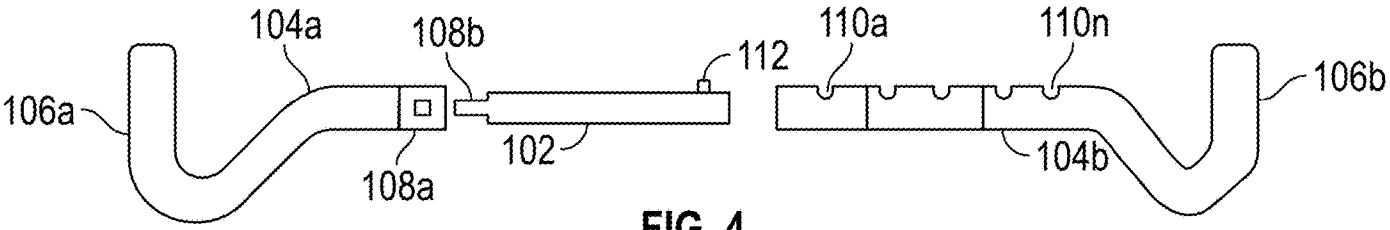

As shown in FIG. 4, the end member 104*a* may have a female quick connect element 108*a* attached thereto and the shaft 102 may have a male quick connect element 108*b* attached thereto. As understood in the art, the female quick connect element 108*a* may have a sleeve that recedes when the male quick connect element 108*b* is inserted to connect the two elements 108*a* and 108*b*, and when the two are connected, the sleeve is released so that the elements 108*a* and 108*b* remain rotatably engaged with one another. On the other end of the shaft 102, a spring pin 112 may extend through an opening defined by a wall of the shaft 102 and sized to enable the spring pin 112 to extend therethrough. A user may press on the spring pin 112 to insert the shaft 102 into an opening defined by a circular wall of the end member 104*b*. The user may align the spring pin 112 with one of the openings 110 to set a length of the device 100 so that the interface features 106 (e.g., handles) have a separation distance that is defined by the shaft 102 as limited by the location of the spring pin 112 being within one of the openings 110. The user may press and align the spring pin 112 with another one of the openings 110 to change the overall length of the fitness device 100.

Figure 5:
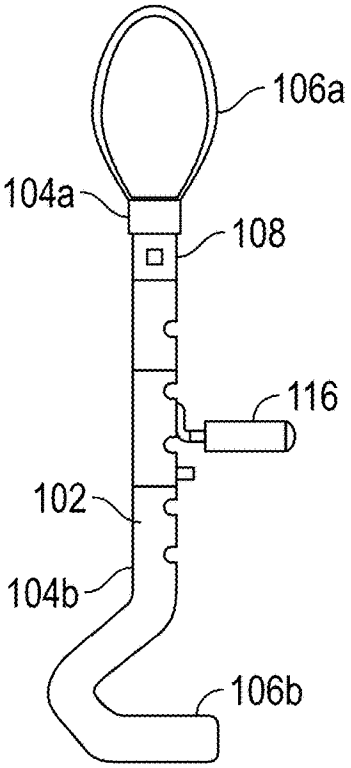

FIG. 5 is an illustration of another embodiment of the device 100, but rather than having two handles as the user interface features 106*a* and 106*b*, a strap or other features may be connected, thereby providing for a strap that forms a loop on one end and a handle on the other end. The strap may be used by the user to place a foot therein or grasp the loop and the user may hold the handle or press his or foot against the handle when using the device 100. The end member 104*a* may be connected to a male or female component of the quick connect 108, and the shaft 102 may have a mate to the component of the quick connect 108 connected to the end member 104*a*, thereby enabling the end member 104*a* to easily connect and disconnect along with rotate. This embodiment of the device 100 may include the extra handle 116 set along the shaft 102, and the handle 116 may be configured to rotate from being parallel to being perpendicular with the shaft 102.

FIGS. 6A-6H are images of an illustrative fitness device 600 that shows a configuration of the fitness device 600 inclusive of a shaft 602 that attaches to a first end member 604*a* and second end member 604*b* (collectively 604) that include linear portions 605*a* and 605*b* (collectively 605) that may be linearly and coaxially connected to the shaft 602 (or one another if the shaft 602 is integrated into one of the end member 606). The user interface features 606 may be formed as handles at each end of the fitness device 600 for a user to grip or press against with his or her hands, feet, or other anatomical region. The end member 606 may include curved regions 607*a* and 607*b* (collectively 607) that allows for a user to more easily engage with the interface features 606 along a central axis of the shaft 602. Each of FIGS. 6A-6F show views of respective left side, right side, front, back, top, bottom sides of the device 600.

Figure 6E:
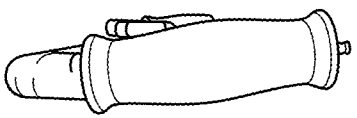
FIGS. 6A-6H are images of an illustrative fitness device or tool including handles at each end of the device for a user to grip or press against with his or her hands, feet, or other anatomical region.
Figure 6F:
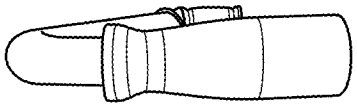
Figure 6D:
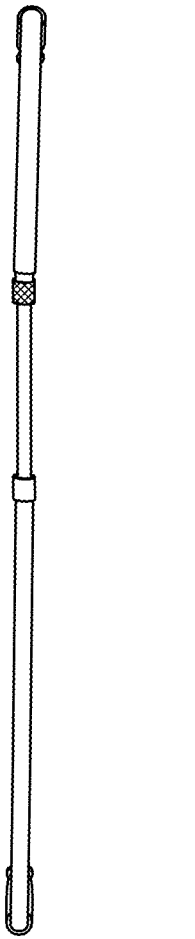
Figure 6C:
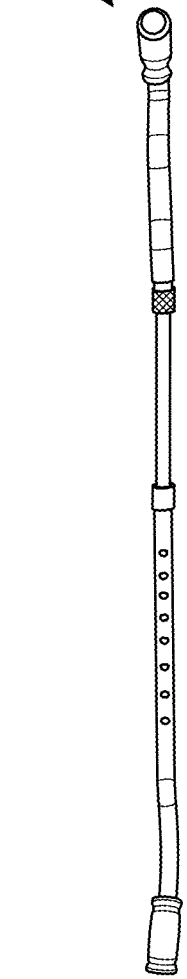
Figure 6B:
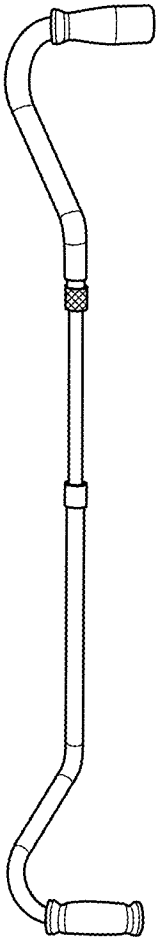
Figure 6A:
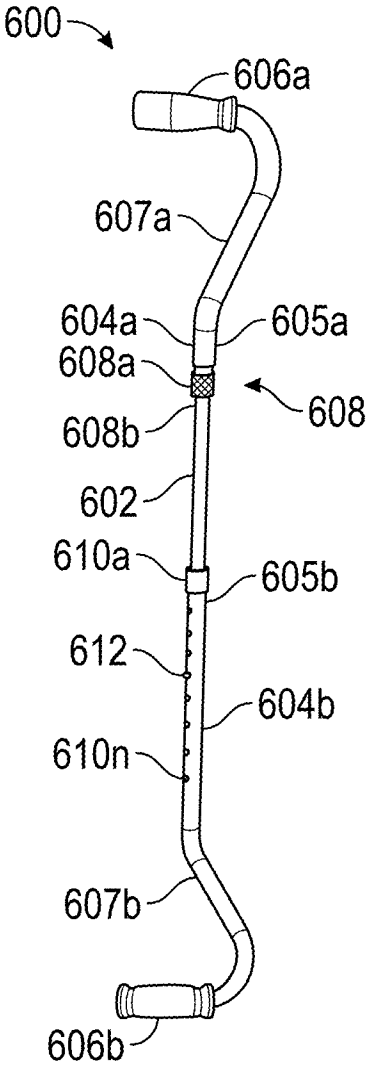
Figure 6H:
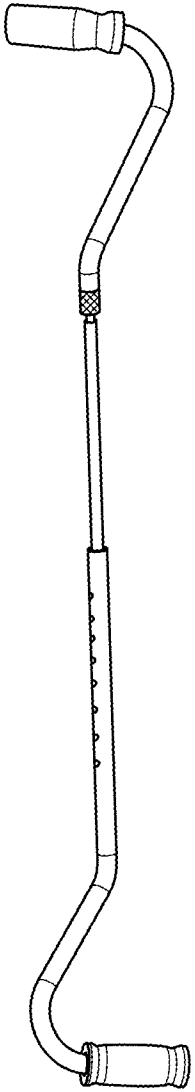
Figure 6G:
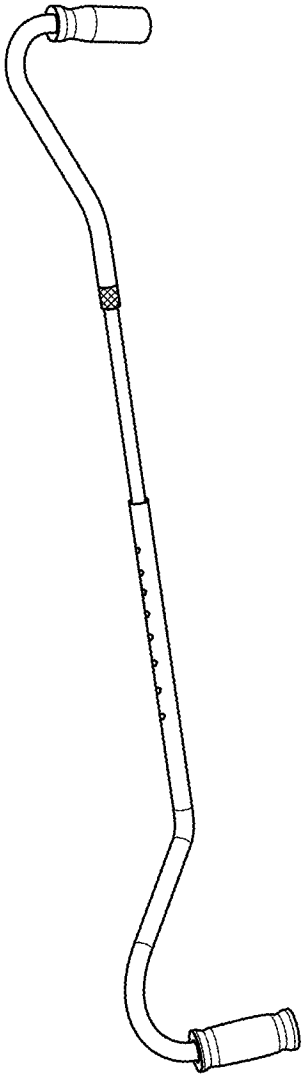

FIG. 6G and FIG. 6H show perspective views and FIG. 6H shows that the interface features 606, in this case handles, are rotatable relative to one another via a quick connect component 608 that that enables full rotation of the two end members 604 and interface features 606 relative to one another. The quick connect 608 may include a female quick connect component 608*a* and male quick connect component 608*b* that are configured to engage, not separate from one another, but rotate relative to one another with unlimited rotation (i.e., 360 degree rotation). In an embodiment, rather than having a single quick connect component 608, multiple quick connect components (e.g., one for each handle) may be utilized. However, the use of multiple quick connect components may cost more to produce, and in some embodiments, provide minimal difference in terms of functionality as compared to having a single quick connect. As previously described, shaft 602 may include an array of openings 610*a*-610*n* (collectively 610) and end member 604*a* may include a spring pin 612 configured to be engaged with one of the openings 610. The spring pin 612 may be aligned extend through one of the openings 610 so as to allow for the device to be longer or shorter (see also, for example, FIGS. 8A and 8B). In an alternative embodiment, the openings 610 may be disposed on the end member 604*b* along the linear portion 605*b*, and the spring pin 612 may be secured to the shaft 602. The shape of the fitness tool 600 also has an ornamental appearance that is aesthetic in an apart from the functionality of the tool.

Figure 7A:
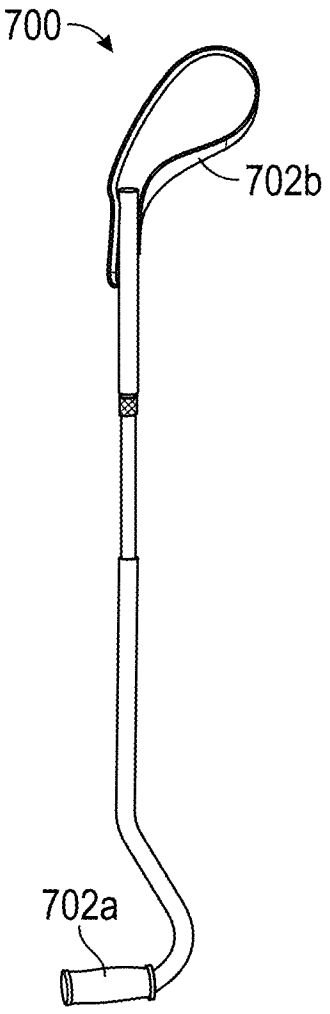
FIGS. 7A-7C are images of an illustrative fitness device with one end being shaped as a handle and the other end including a strap (e.g., leather strap)
Figure 7B:
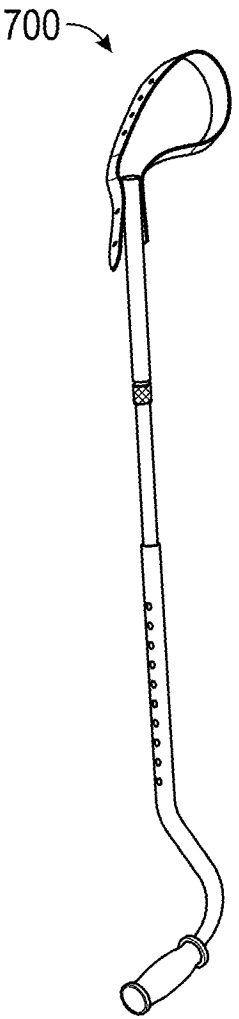
Figure 7C:
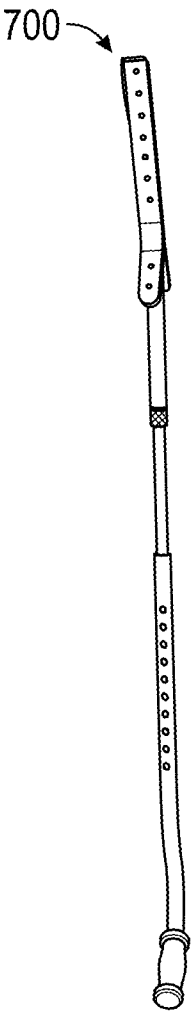

FIGS. 7A-7C are images of an illustrative fitness device 700 with one end including an interface feature 702*a* being shaped as a handle and the other end including an interface feature 702*b* being shaped as a strap (e.g., leather or other soft or flexible material strap). The strap may be a loop or any other configuration that enables a user to secure his or her hand, foot, or other anatomical region. Alternatively, the interface feature may be a loop, triangle, or any other shape and may be rigid (i.e., not easily bent or resistant to being bent) or flexible (i.e., easily bent). The strap may define multiple holes extending linearly along the strap, and a pin, clasp, buckle, or any other attachment mechanism that can insert into one or more of the holes so as to retain the loop at a certain length or profile.

Figure 8A:
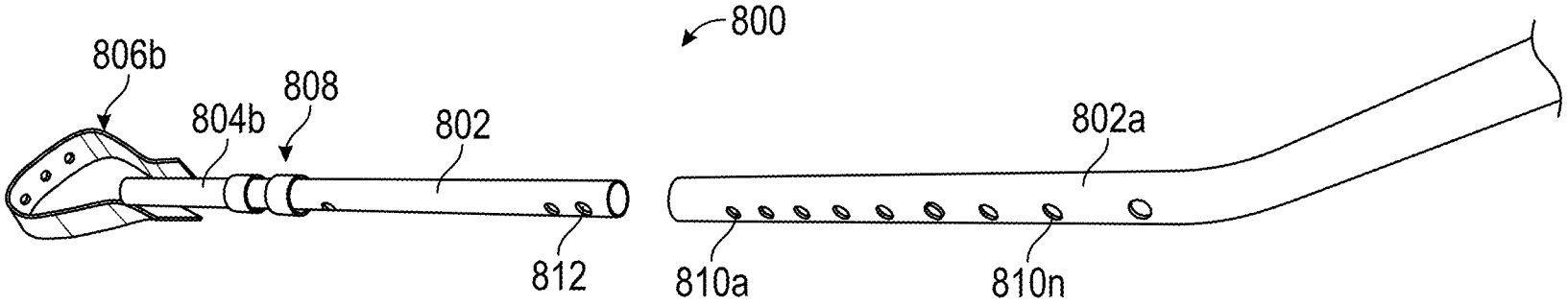
FIGS. 8A and 8B are images of an illustrative pair of shafts for a handle that enables altering length of the fitness tool by disengaging and reengaging a spring pin or other feature along a length of the shafts.
Figure 8B:
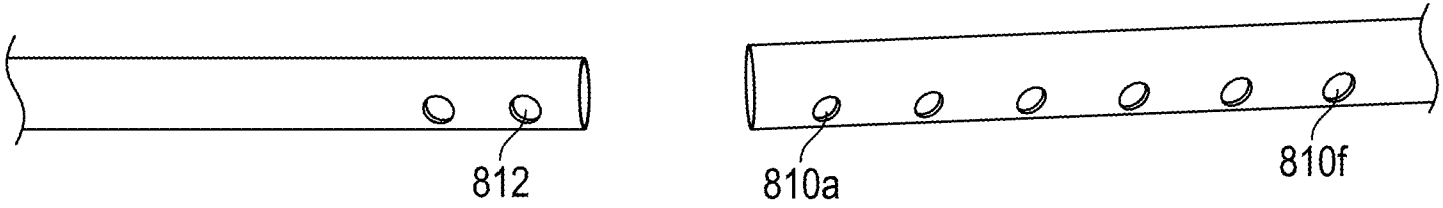

FIGS. 8A and 8B are images of a portion of a fitness device 800 including a shaft 802 and end member 804*a* that extends to a user interface feature (not shown), such as a handle, where the end member 804*a* defines a series of openings 810*a*-810*n* (collectively 810) through which a spring pin 812 may engage one of the openings 810 to alter length of the fitness tool 800. End member 804*b* may include a user interface feature 806*b* of an adjustable strap, as shown, or non-adjustable strap. Additionally, the end member 804*b* may rotatably connect to the shaft 802 via a quick connect component 808, as previously described. The length of the fitness device 800 may be defined by which of the openings 810*a*-810*n* the spring pin 812 is interfaced, as previously described, thereby preventing rotation of the shaft 802 relative to the end member 804*a*, while the quick connect component 808 enables the end member 804*b* and user interface feature 806*b* to be rotated relative to the shaft 802 and consequently end member 804*a*, thereby enabling a user to rotate the user interface feature 806*b* relative to a handle, for example, as a user interface feature (not shown) connected to or part of the end member 804*a*.

Figure 9A:
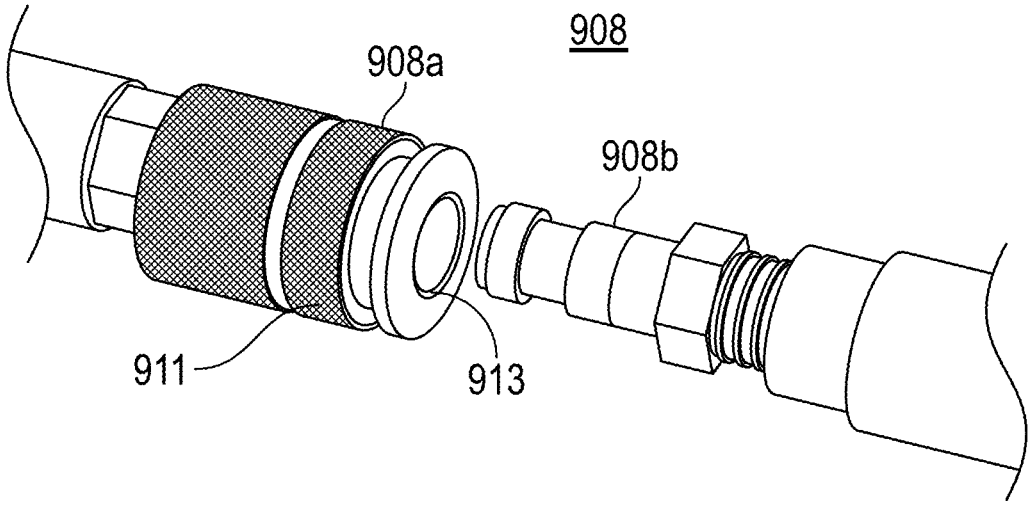
FIGS. 9A and 9B are images of an illustrative quick release (or connect) that enables securing and rotating two shafts of a fitness device as shown herein.
Figure 9B:
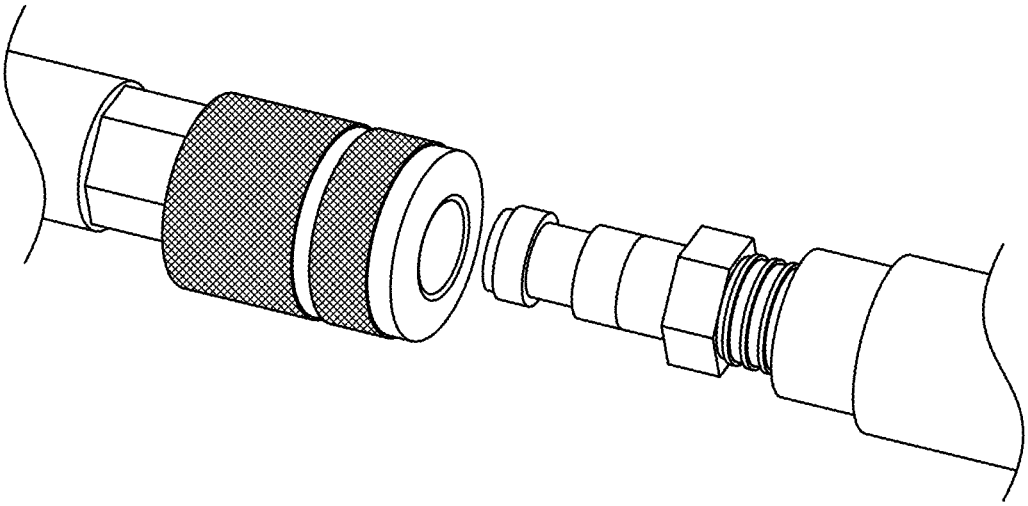

FIGS. 9A and 9B are images of an illustrative quick release (or connect) 908 that enables securing and rotating two shafts of a fitness device relative to one another as shown herein. The quick connect 908 includes a female quick connect component 908*a* and a male quick connect component 908*b* that, when interfaced to the female quick connect component 908*a*, maintains the two components 908 together and allows the two to rotate relative to one another. To connect or disconnect one another, a sleeve 911 may be recessed and the male quick connect component 908*b* may be inserted into or withdrawn from an opening 913 of the female quick connect component 908*a*. While connected, the male and female quick connect components 908*a* and 908*b* may rotate relative to one another.

Figure 10A:
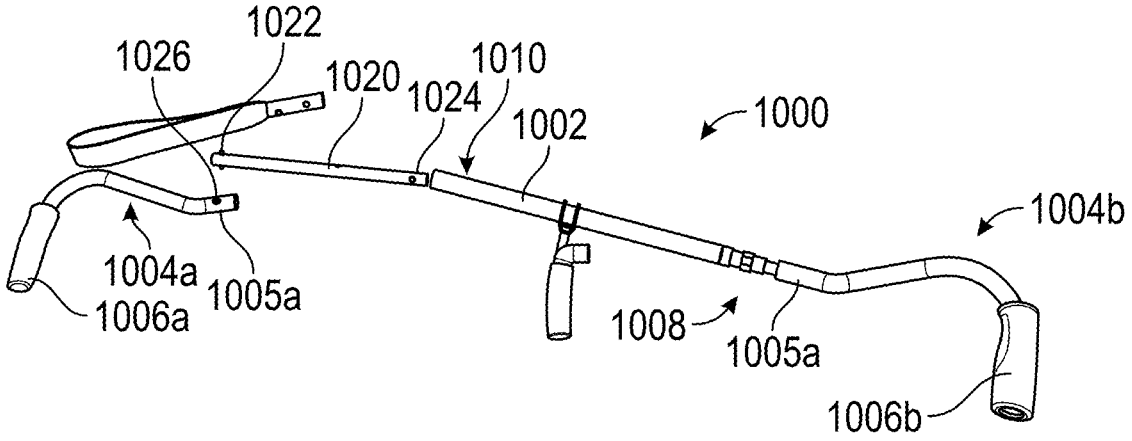
FIGS. 10A and 10B are images of an illustrative fitness tool configured with an inside shaft used to indirectly secure an end member to a shaft.
Figure 10B:
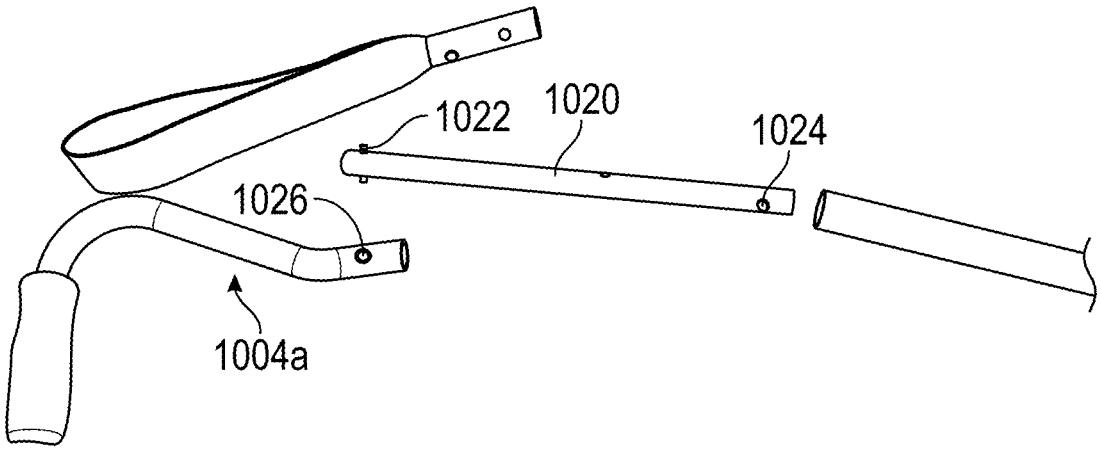

With regard to FIGS. 10A and 10B, images of an illustrative fitness tool 1000 configured with an inside shaft 1020 used to indirectly secure an end member 1004*a* to a shaft 1002 is shown. The fitness tool 1000 includes first and second end members 1004*a* and 1004*b*. On a first end, the shaft 1002 is attached to an interconnect feature 1008, which may be a quick connect component, that interconnects the shaft to the end member 1004*b* to enable rotation, but not separation, as previously described. One the second end (and extending towards the first end), a series of openings 1010 defined by the shaft 1002 may be disposed. The openings 1010 may be considered interconnect feature(s). The inner shaft 1020 may include two interconnect features 1022 and 1024. Each of the interconnect features 1022 and 1024 may be spring pins that extend through respective openings (not shown) defined by the inner shaft 1020. The inner shaft 1020 may be sized to extend through the shaft 1002, and the interconnect feature 1024 is to extend through one of the openings 1010 to maintain the inner shaft 1020 in releasable engagement with the shaft 1002. Once engaged, the inner shaft 1020 and shaft 1002 shall have minimal motion therebetween so that the user may perform fitness exercises therewith. On the other end of the inner shaft, the interconnect feature 1022 may engage an opening 1026 defined by the end member 1004*a*, thereby preventing rotational or axial motion between the inner shaft 1020 and end member 1004*a*. By using the inner shaft 1020, the fitness tool 1000 may have four major components, including end members 1004*a* and 1004, shaft 1002, and inner shaft 1020, which allows for the fitness tool, which disassembled into the four major components, to be short enough to fit into a smaller pouch for easier transport.

One embodiment of a fitness tool may include a first end member including (i) a first linear portion, (ii) a first interconnect feature connected to one end of the first end member along the linear portion, and (iii) a first user interface feature disposed at an opposite end of the first end member from the first interconnect feature. The fitness tool may include a second end member including (i) a second linear portion, (ii) a second interconnect feature disposed at one end of the second end member along the linear portion, and (iii) a second user interface feature disposed at an opposite end of the second end member from the second interconnect feature. A shaft may be elongated and have third and fourth interconnect features on respective ends of the shaft that interconnect with the first and second interconnect features of the first and second end members. The first and third interface features, when longitudinally engaged with one another, enable the first end member and shaft to rotate relative to one another such that when the user holds the first user interface feature with one hand and the second user interface feature with the other hand or foot, the first and second user interface features are able to rotate relative to one another and remain at a fixed distance from one another.

The shaft, first linear portion of the first end member, and second linear portion of the second end member may be coaxial with one another. The first interconnect feature and third interconnect feature may be quick connect elements that are configured to rotatably connect with one another. The second interconnect feature and fourth interconnect features may be a spring pin and a sequence of openings defined by the shaft through one of which at a time the spring pin is capable of engaging, thereby preventing rotation of and separation of the second end member relative to the shaft.

The first user interface feature may be a handle and the second user interface feature may be a handle. One of the first or second user interface feature may be a handle and the other of the first or second user interface feature may be a looped strap. Each of the first and second end members may have a curved portion between the respective first and second linear portions and first and second user interface features. The shaft, first linear portion, and second linear portion may have circular profiles. An inner shaft component may include fifth and sixth interconnect features that are configured to respectively interconnect with the second interconnect feature and the fourth interface feature of the shaft, where the inner shaft component may be configured to extend through the shaft to align the sixth interconnect feature with the fourth interface feature to set a distance between the first and second user interface features of the respective first and second end members. The fitness tool may further include an adapter connected to the shaft, and a third user interface feature connected to the adapter, thereby enabling the user to interact with the third user interface feature when using the fitness tool rather than one of the first or second user interface features.

One embodiment of a fitness tool for a user to use in performing fitness activities may include a first member including (i) a first elongated shaft, the first elongated shaft including a first interface feature on a first end of the first elongated shaft, and (ii) a handle disposed at the second end, and a second member including a second elongated shaft. The second elongated shaft may include a second interface feature at a first end of the second elongated shaft. The first and second interface features, when longitudinally engaged with one another, enable the first and second shafts to rotate about relative to one another, the second elongated shaft including a hand or foot engagement mechanism such that when the user holds the handle with one hand and the hand or foot engagement mechanism with the other hand or foot is able to cause the first and second members to rotate about the longitudinal axis relative to one another.

The first shaft may include an inner shaft and an outer shaft, where the outer shaft may include multiple first locking features extending longitudinally along the outer shaft. The inner shaft may include a second locking feature configured to engage with one of the first locking features when the inner and outer shafts are slidably and longitudinally engaged with one another, thereby enabling the stretching tool to have different lengths.

The first locking features may include openings defined by the outer shaft. The second locking feature may be a moveable component configured to extend through an opening of one of the openings, that, when extended through the opening, prevents the inner and outer shafts from sliding longitudinally or rotating axially relative to one another.

The handle may be disposed at the second end of the first elongated shaft, and be substantially perpendicular to the longitudinal axis of the shaft.

The hand or foot engagement mechanism may be a handle that is substantially perpendicular to the longitudinal axis of the shaft. In an embodiment, the hand or foot engagement mechanism is a strap.

The first and second interface features may be configured to be selectably released from one another. The first interface feature may include a retractable member that, in a retracted state, enables the first and second interface features to be engaged or disengaged from one another, and in a non-retracted state, prevents the first and second interface features from engaging or disengaging from one another while being able to rotate relative to one another without disengaging from one another when engaged.

The first member may further include a curved portion positioned between the first elongated shaft and the handle. The second member may include a curved portion positioned between the second elongated shaft and the hand or foot engagement mechanism such that the longitudinal axis of the connected first and second shafts pass through the handle and the hand or foot engagement mechanism.

One embodiment of a method for manufacturing a fitness tool may include connecting a first member to a second member. The first member may include (i) a first elongated shaft, where the first elongated shaft may include a first interface feature on a first end of the first elongated shaft, and (ii) a handle disposed at the second end. The second member may include a second elongated shaft, where the second elongated shaft may include a second interface feature at a first end of the second elongated shaft. The first and second interface features, when longitudinally engaged with one another, may enable the first and second shafts to rotate about relative to one another. The second elongated shaft may include a hand or foot engagement mechanism such that when the user holds the handle with one hand and the hand or foot engagement mechanism with the other hand or foot is able to cause the first and second members to rotate about the longitudinal axis relative to one another.

The first shaft may include an inner shaft and an outer shaft, where the outer shaft may include multiple first locking features extending longitudinally along the outer shaft, and the inner shaft may include a second locking feature configured to engage with one of the first locking features when the inner and outer shafts are slidably and longitudinally engaged with one another, thereby enabling the stretching tool to have different lengths.

The first locking features may be openings defined by the outer shaft, and the second locking feature may be a moveable component configured to extend through an opening of one of the openings, that, when extended through the opening, prevent the inner and outer shafts from sliding longitudinally or rotating axially relative to one another.

The handle may be disposed at the second end of the first elongated shaft, and be substantially perpendicular to the longitudinal axis of the shaft. The hand or foot engagement mechanism may be a handle that is substantially perpendicular to the longitudinal axis of the shaft. In an embodiment, the hand or foot engagement mechanism is a strap.

The first and second interface features may be configured to be selectably released from one another. The first interface feature may include a retractable member that, in a retracted state, enables the first and second interface features to be engaged or disengaged from one another, and in a non-retracted state, prevents the first and second interface features from engaging or disengaging from one another while being able to rotate relative to one another without disengaging from one another when engaged.

The first member may further include a curved portion positioned between the first elongated shaft and the handle. The second member may include a curved portion positioned between the second elongated shaft and the hand or foot engagement mechanism such that the longitudinal axis of the connected first and second shafts pass through the handle and the hand or foot engagement mechanism.

The previous description is of at least one embodiment for implementing the invention, and the scope of the invention should not necessarily be limited by this description. The scope of the present invention is instead defined by the following claims.

What is claimed is:

1. A fitness tool for a user to use in performing fitness activities, said fitness tool comprising:

a first end member including (i) a first linear portion, (ii) a first interconnect feature connected to one end of the first end member along the linear portion, and (iii) a first user interface feature disposed at an opposite end of the first end member from the first interconnect feature;

a second end member including (i) a second linear portion, (ii) a second interconnect feature disposed at one end of the second end member along the linear portion, and (iii) a second user interface feature disposed at an opposite end of the second end member from the second interconnect feature; and a shaft being elongated and having third and fourth interconnect features on respective ends of the shaft that interconnect with the first and second interconnect features of the first and second end members, the first and third interface features, when longitudinally engaged with one another, enable the first end member and shaft to rotate relative to one another such that when the user holds the first user interface feature with one hand and the second user interface feature with the other hand or foot, the first and second user interface features are able to rotate relative to one another and remain at a fixed distance from one another.

2. The fitness tool according to claim 1, wherein the shaft, first linear portion of the first end member, and second linear portion of the second end member are co-axial with one another.

3. The fitness tool according to claim 1, wherein the first interconnect feature and third interconnect feature are quick connect elements that are configured to connect with one another and be rotatable relative to one another when connected.

4. The fitness tool according to claim 1, wherein the second interconnect feature and fourth interconnect features are a spring pin and a sequence of openings defined by the shaft through one of which at a time the spring pin is capable of engaging, thereby preventing rotation of and separation of the second end member relative to the shaft.

5. The fitness tool according to claim 1, wherein the first user interface feature is a handle and the second user interface feature is a handle.

6. The fitness tool according to claim 1, wherein one of the first or second user interface feature is a handle and the other of the first or second user interface feature is a looped strap.

7. The fitness tool according to claim 1, wherein each of the first and second end members have a curved portion between the respective first and second linear portions and first and second user interface features.

8. The fitness tool according to claim 1, wherein the shaft, first linear portion, and second linear portion have circular profiles.

9. The fitness tool according to claim 1, further comprising an inner shaft component including fifth and sixth interconnect features that are configured to respectively interconnect with the second interconnect feature of the second end member and the fourth interface feature of the shaft, the inner shaft component being configured to extend through the shaft to align the sixth interconnect feature with the fourth interface feature to set a distance between the first and second user interface features of the respective first and second end members.

10. The fitness tool according to claim 1, further comprising:

an adapter connected to the shaft; and a third user interface feature connected to the adapter, thereby enabling the user to interact with the third user interface feature when using the fitness tool rather than one of the first or second user interface features.

11. A method for manufacturing a fitness tool, comprising:

connecting a first member to a second member, the first member including (i) a first elongated shaft, the first elongated shaft including a first interface feature on a first end of the first elongated shaft, and (ii) a handle disposed at the second end; and the second member including a second elongated shaft, the second elongated shaft including a second interface feature at a first end of the second elongated shaft, the first and second interface features, when longitudinally engaged with one another such that the first elongated shaft and the second elongated shaft are coaxial, enable the first and second shafts to rotate relative to one another, the second elongated shaft including a hand or foot engagement mechanism such that when the user holds the handle with one hand and the hand or foot engagement mechanism with the other hand or foot is able to cause the first and second members to rotate about the longitudinal axis relative to one another.

12. The method according to claim 11, wherein the first shaft includes an inner shaft and an outer shaft, the outer shaft including a plurality of first locking features extending longitudinally along the outer shaft, and wherein the inner shaft includes a second locking feature configured to engage with one of the first locking features when the inner and outer shafts are slidably and longitudinally engaged with one another, thereby enabling the stretching tool to have different lengths.

13. The method according to claim 12, wherein the first locking features are openings defined by the outer shaft, and wherein the second locking feature is a moveable component configured to extend through an opening of one of the openings, that, when extended through the opening, prevent the inner and outer shafts from sliding longitudinally or rotating axially relative to one another.

14. The method according to claim 11, wherein the handle disposed at the second end of the first elongated shaft is substantially perpendicular to the longitudinal axis of the first elongated shaft.

15. The method according to claim 11, wherein the hand or foot engagement mechanism is a handle that is substantially perpendicular to the longitudinal axis of the first elongated shaft.

16. The method according to claim 11, wherein the hand or foot engagement mechanism is a strap.

17. The method according to claim 11, wherein the first and second interface features are configured to be selectably released from one another.

18. The method according to claim 17, wherein the first interface feature includes a retractable member that, in a retracted state, enables the first and second interface features to be engaged or disengaged from one another, and in a non-retracted state, prevents the first and second interface features from engaging or disengaging from one another while being able to rotate relative to one another without disengaging from one another when engaged.

19. The method according to claim 11, wherein the first member further includes a curved portion positioned between the first elongated shaft and the handle.

20. The method according to claim 19, wherein the second member includes a curved portion positioned between the second elongated shaft and the hand or foot engagement mechanism such that the longitudinal axis of the connected first and second shafts pass through the handle and the hand or foot engagement mechanism.

21. A method for manufacturing a fitness tool, comprising:

connecting a first member to a second member, the first member including (i) a first elongated shaft, the first elongated shaft including a first interface feature on a first end of the first elongated shaft, and (ii) a handle disposed at the second end; and the second member including a second elongated shaft, the second elongated shaft including a second interface feature at a first end of the second elongated shaft, the first and second interface features, when longitudinally engaged with one another, enable the first and second shafts to rotate about relative to one another, the second elongated shaft including a hand or foot engagement mechanism such that when the user holds the handle with one hand and the hand or foot engagement mechanism with the other hand or foot is able to cause the first and second members to rotate about the longitudinal axis relative to one another, the first and second interfaces further being configured to be selectably released from one another, the first interface feature further including a retractable member that, in a retracted state, enables the first and second interface features to be engaged or disengaged from one another, and in a non-retracted state, prevents the first and second interface features from engaging or disengaging from one another while being able to rotate relative to one another without disengaging from one another when engaged.

22. The method according to claim 21, further comprising coaxially aligning the first and second elongated shafts with one another.

* * * * *